US008028971B2

(12) United States Patent
Guirado Tristan et al.

(10) Patent No.: US 8,028,971 B2
(45) Date of Patent: Oct. 4, 2011

(54) ELECTROMAGNETIC SAFETY VALVE

(75) Inventors: Jose Antonio Guirado Tristan, Beasain (ES); Marcos Pablo Curto, Hernani (ES); José Maria Lasa Elexpuru, Oñati (ES)

(73) Assignee: Mondragon Componentes, S.Coop., Aretxabaleta (Gipuzkoa) (ES)

( * ) Notice: Subject to any disclaimer, the term of this patent is extended or adjusted under 35 U.S.C. 154(b) by 541 days.

(21) Appl. No.: 12/234,043

(22) Filed: Sep. 19, 2008

(65) Prior Publication Data

US 2009/0078901 A1 Mar. 26, 2009

(30) Foreign Application Priority Data

Sep. 20, 2007 (EP) ..... 07380255
Mar. 5, 2008 (EP) ..... 08380065

(51) Int. Cl.
*F16K 31/02* (2006.01)

(52) U.S. Cl. ..... 251/129.15; 335/267; 335/299

(58) Field of Classification Search ..... 335/296, 335/297, 299; 251/129.01, 129.15
See application file for complete search history.

(56) References Cited

U.S. PATENT DOCUMENTS 4,100,519 A 7/1978 Neff
5,331,730 A * 7/1994 Brinn, Jr. ..... 29/606
5,785,511 A 7/1998 Shah
6,816,050 B2 * 11/2004 Just et al. ..... 335/296
7,661,653 B2 * 2/2010 Kondoh ..... 251/129.15
7,866,627 B2 * 1/2011 Ohi et al. ..... 251/129.07
2004/0051069 A1 3/2004 Miyazoe

FOREIGN PATENT DOCUMENTS

EP 1036987 A2 9/2000
EP 1063474 A1 12/2000
EP 1624247 A2 2/2006
ES 1062961 8/2006

OTHER PUBLICATIONS

European Patent Office, European Search Report for European Patent Application No. 07380255, Mar. 26, 2006, Munich.

* cited by examiner

*Primary Examiner* — John Fristoe, Jr.
(74) *Attorney, Agent, or Firm* — Tim L. Kitchen; Peter B. Scull; Berenbaum Weinshienk PC

(57) ABSTRACT

An electromagnetic safety valve that includes a reel, a support that has a first segment that is inserted in the interior of the reel and which acts as a fixed core, a movable core that moves in the interior of the reel, a sealing member connected to one end of the movable core that opens a passage of gas overcoming the opposition of a spring when the valve is energised, and a casing that encloses the reel. The support has a second segment that includes a base upon which the reel is supported, the base including axial through holes for the respective passage of a phase wire and a mass wire. The second segment also includes a coaxial housing wherein a male terminal is inserted.

18 Claims, 8 Drawing Sheets

ELECTROMAGNETIC SAFETY VALVE

CROSS-REFERENCE TO RELATED APPLICATIONS

This application claims priority to European Patent Application No. 07380255.5, filed 20 Sep. 2007 and to European Patent Application No. 08380065.6, filed 5 Mar. 2008.

TECHNICAL FIELD

The present disclosure relates to electromagnetic safety valves adapted to domestic gas appliances, the valves being activated and kept open by means of an external DC voltage.

BACKGROUND

There are known electromagnetic gas safety valves that are inserted in gas taps adapted to a cooking appliance or domestic stove. In this type of valve the reels are initially energised by a manual thrust or DC voltage until a low-voltage electrical current, conditional on the presence of a flame in a thermocouple, is capable of keeping the electromagnetic valve open.

Spanish Patent No. ES1062961U discloses a rotary gas tap adapted to a domestic cooking or heating appliance, with an electromagnetic safety valve integrated into the body of the tap, powered by a low-power external VDC voltage, and which has a cylindrical movable core guided axially when moved in the interior of a reel and which includes on one end a sealing member that opens or closes a passage of gas, a magnetic core that includes a base and a fixed core that is inserted inside the reel, and a magnetic capsule that envelops the reel as part of the magnetic circuit of the electromagnet.

SUMMARY OF THE DISCLOSURE

An object is to provide electromagnetic safety valves adapted to domestic gas appliances as disclosed herein and defined in the claims.

In one embodiment, an electromagnetic safety valve is adapted for being integrated into a combustion appliance and comprises a reel that includes a bobbin and an electrical coil reeled onto the exterior of the bobbin, a support in which the reel is seated and which has a first segment that is inserted in the interior of the reel and which acts as a fixed core, a movable core that is guided axially when moved in the interior of the reel, the movable core being attracted towards the support when the electromagnetic valve is energised, a sealing member coupled to one end of the movable core which opens a passage of gas overcoming the opposition force exerted by a return spring when the electromagnetic valve is energised, and a metal casing enclosing the reel, the movable core and the support in its interior.

According to one embodiment, the electromagnetic safety valve is optimised by integrating into a single unit the fixed core, a seat or base for the reel, structure for attaching a male terminal and for accommodating the connection of a phase wire of the coil through the male terminal, and the connection of a mass wire of the coil to mass, the single unit being the support. For this purpose, in one embodiment, the support has a second segment, coaxial and continuous to the first segment and having a substantially transversal base upon which the reel is seated, and a coaxial housing in which is inserted the substantially cylindrical and hollow male terminal. Axially disposed openings in the base accommodate the passage of the phase wire and mass wire of the coil, the mass wire being fixed to the support for its connection to mass, and the phase wire axially passing through the male terminal, to which it is fixed at one end.

In an alternative embodiment the support is constructed of two parts, a first and second segment. While in a third embodiment the support is constructed of three parts.

In accordance with one embodiment, an electromagnetic safety valve is provided having a reel comprising a bobbin having an interior passage and an electrical coil reeled onto an exterior surface of the bobbin, a moveable core moveable within the interior passage of the bobbin and having a first contact surface, a sealing member at a first end of the valve which is configured to open or close a passage of gas, the sealing member coupled to the moveable core and being urged in a closed position by a spring, a mass wire electrically coupled to the reel a phase wire electrically coupled to the reel, a male terminal positioned at a second end of the valve opposite the first end and having a passage for receiving the phase wire, a metallic support comprising a first segment and a second segment, the mass wire being electrically coupled to the support, the first segment acts as a fixed core and comprises an external surface and a second contact surface, at least a portion of the external surface is positioned within the internal passage of the bobbin, the second contact surface configured to mate with the first contact surface of the moveable core when the valve is energized to hold the sealing member in an open position, the second segment being coaxial or substantially coaxial with the first segment, the second segment having at or near one end a base that supports the reel and at a second end an opening for receiving the male terminal, the base having a first opening for passage of the mass wire and a second opening for passage of the phase wire, and a metal casing enclosing the reel and attached to the support.

In accordance with another embodiment, a support structure for an electromagnetic safety valve for a domestic gas appliance is provided comprising an elongate first segment that acts as a fixed core and is configured to be received within a reel of the electromagnetic safety valve, and a second segment coaxial with the first segment having at or near one end a base for supporting the reel and at a second end an opening for receiving a male terminal that facilitates passage of a phase wire to the reel, the base having a first opening for passage of the phase wire and a second opening for passage of a mass wire.

These aforementioned advantages and characteristics will be made evident in the light of the drawings and the detailed description thereof.

DETAILED DESCRIPTION

Figure 1:
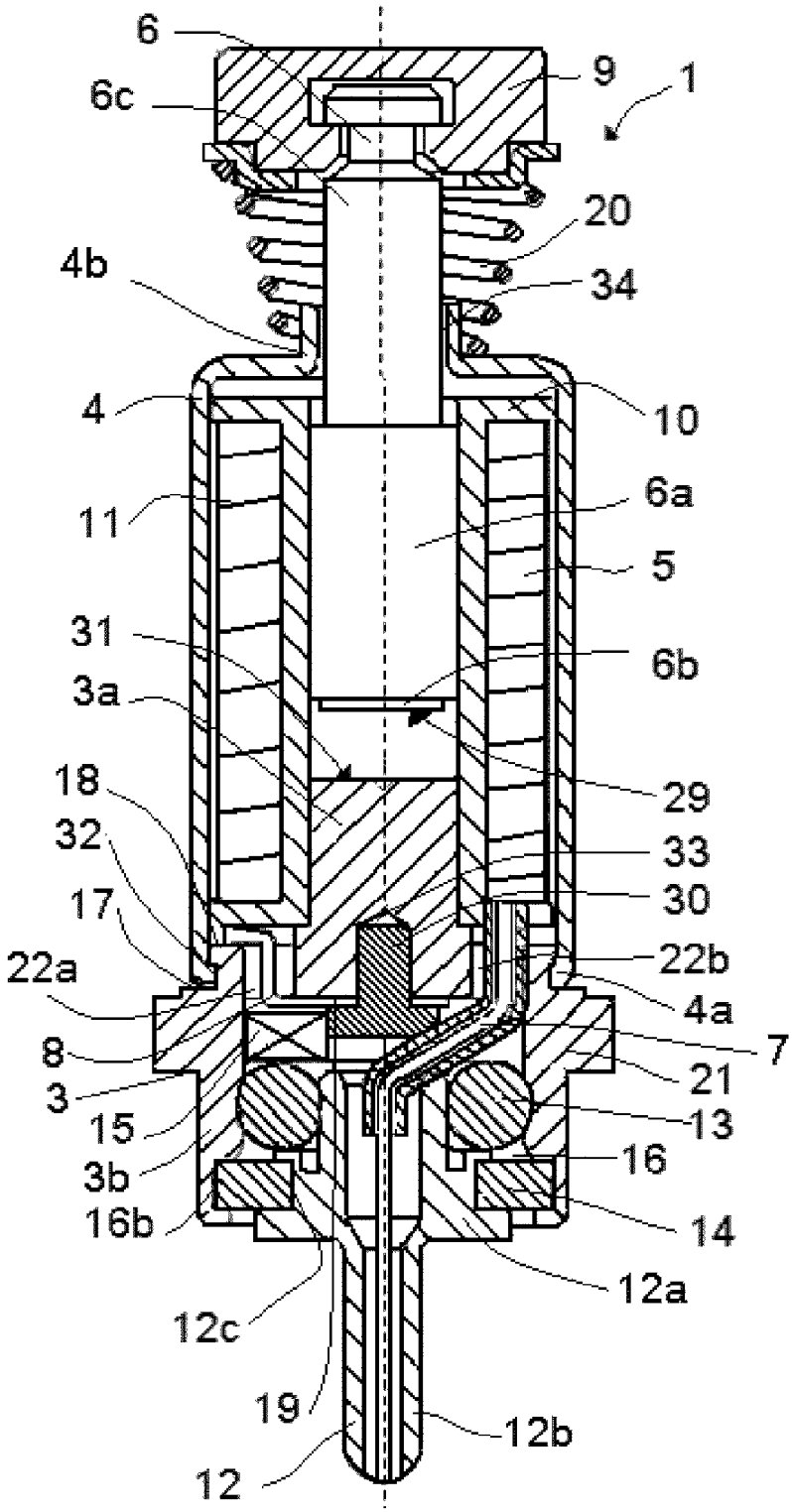
FIG. 1 is a sectioned view an electromagnetic safety valve in an embodiment shown in a position in which the valve is not energised.
Figure 2:
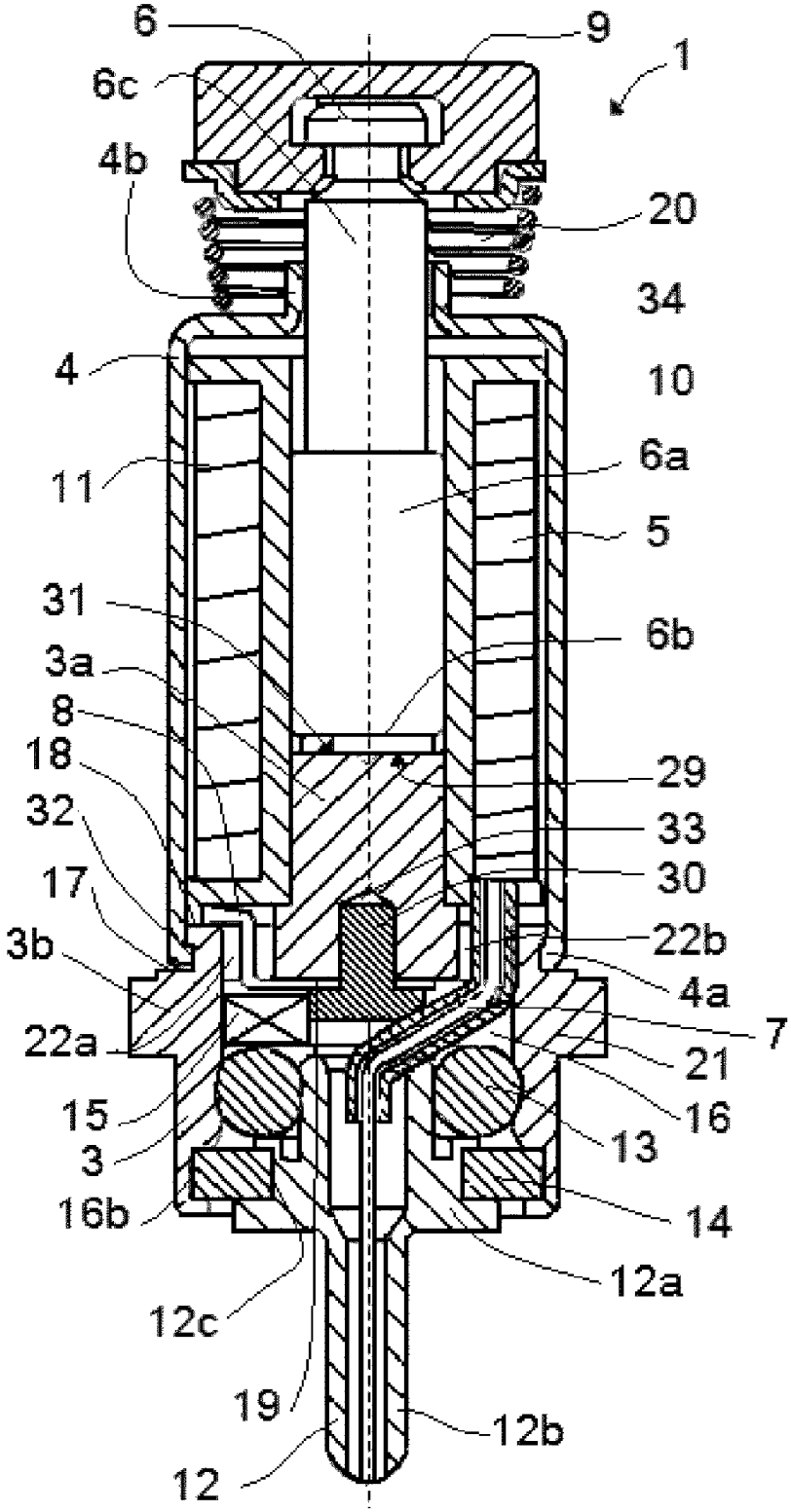
FIG. 2 is a sectioned view of the safety valve of FIG. 1, in a position in which the electromagnetic valve is energised.

FIGS. 1, 2, 5 and 6 show alternative embodiments of an electromagnetic safety valve. In one or more alternative embodiments, an electromagnetic safety valve 1 is provided that comprises a reel 5 supplied by a DC voltage that has a bobbin 10 (preferably plastic) and an electrical coil 11 reeled on the exterior of the bobbin 10, a substantially cylindrical support 3 in which is seated the reel 5, a substantially cylindrical movable core 6 that is guided axially when moved in the interior of the reel 5, the movable core 6 being attracted towards the support 3 when the electromagnetic valve 1 is energised, a sealing member 9 that is coupled to one end of the movable core 6 and which opens a passage of gas overcoming the opposition force exerted by a return spring 20 when the electromagnetic valve 1 is energised, and a metal casing 4 that is seated tightly on the exterior of the support 3, enclosing the reel 5, the movable core 6 and the support 3 in its interior. It is important to note that the support 3 and moveable core 6 may comprise shapes other than cylindrical or substantially cylindrical.

In one embodiment, the support 3 is made of a magnetic material such as iron, the support being a fundamental element of the magnetic circuit of the electromagnetic valve 1. In one embodiment, the support 3 is a unit which includes a first segment 3*a* that has an external surface on which is inserted tightly the bobbin 10 of the reel 5 and a first contact surface 31 against which the magnetic circuit closes a second contact surface 29 of the movable core 6, a second segment 3*b* of revolution that is continuous and coaxial, and with a greater diameter than the first segment 3*a*, and a transversal base 18 upon which the reel 5 is supported, the second segment 3*b* including a perimeter projection 21 for the airtight fitting of the electromagnetic valve 1 in the corresponding domestic gas appliance.

In one embodiment, the second segment 3*b* includes a housing 16 that is coaxial to the support 3 and of a greater diameter than the first segment 3*a*, in the interior of which is inserted a substantially cylindrical and hollow male terminal 12, the housing 16 being connected to the base 18 by means of respective openings 22*a* and 22*b*, spaced apart on the base 18 (preferably arranged diametrically opposed) and axially disposed to the base 18, and through which a phase wire 7 and a mass wire 8 of the coil 11 pass respectively through the support 3, the mass wire 8 being fixed to the support 3 and the phase wire 7 passing through the housing 16, preferably encased in a protective insulating case, and the phase wire 7 being fixed to one end of the male terminal 12. It is appreciated that the hollow male terminal 12 need not have a substantially cylindrical shape.

In an embodiment, the male terminal 12 has on one end a pin 12*b* that projects out of the support 3 and a central part 12*a*, of a greater diameter, which includes a first perimeter recess 12*c*. The male terminal 12 may be a fast connector with different geometries for different types of connection.

In an embodiment, the support 3 incorporates in the housing 16 an airtight closure means 13 such as an O-ring seal that is preferably arranged coaxial to the male terminal 12 and being seated on the exterior of one of the ends of the male terminal 12.

In addition, in one embodiment, the support 3 includes on one end of the housing 16 a second perimeter recess 16*b* in which is inserted an insulating element 14, such as an insulating washer that is fixed coaxial to the male terminal 12. In this way, the insulating element 14 provides, in addition to insulation, a double mechanical fixing of the male terminal 12 in the interior of the support 3 when the insulating element 14 is inserted both in the support 3 and in the male terminal 12.

Figure 3:
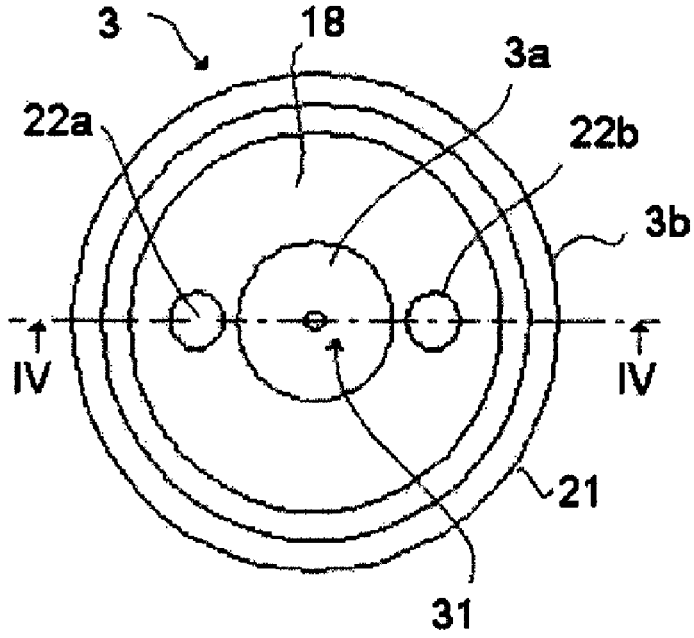
FIG. 3 is a bottom view of a support in an embodiment of the electromagnetic valve shown in FIG. 1.
Figure 4:
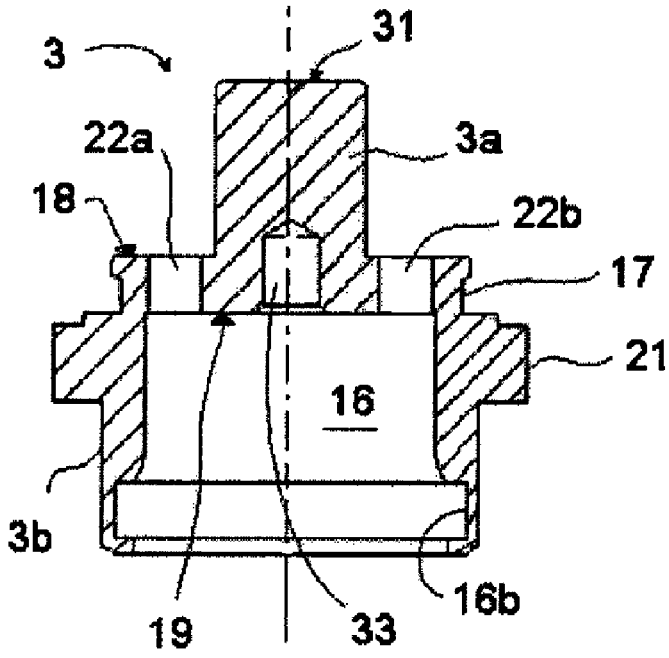
FIG. 4 is a cross-section of the support shown in FIG. 3, according to section IV-IV.
Figure 5:
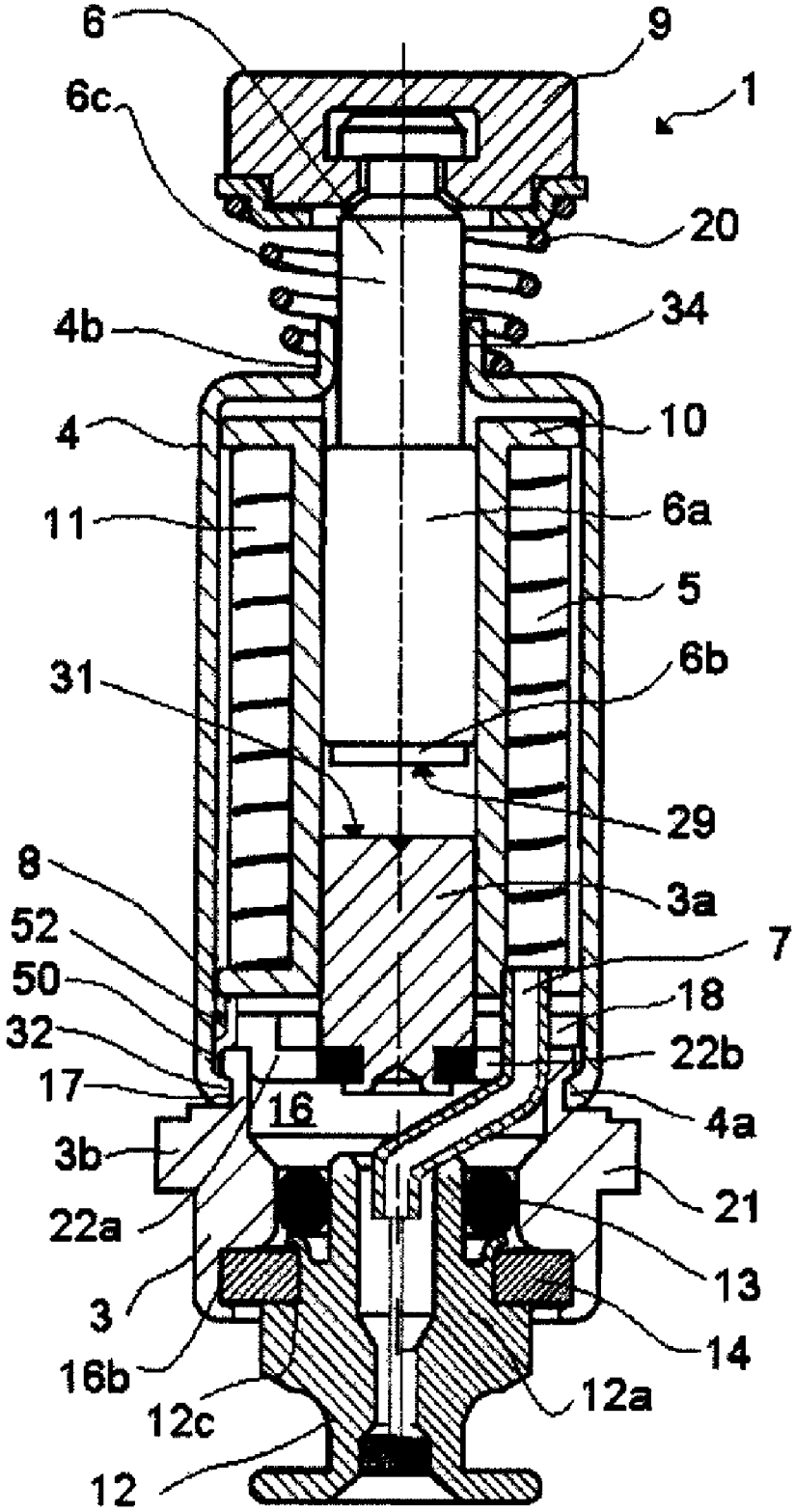
FIG. 5 is a sectioned view of an electromagnetic safety valve in another embodiment shown in a position in which the valve is not energised.
Figure 6:
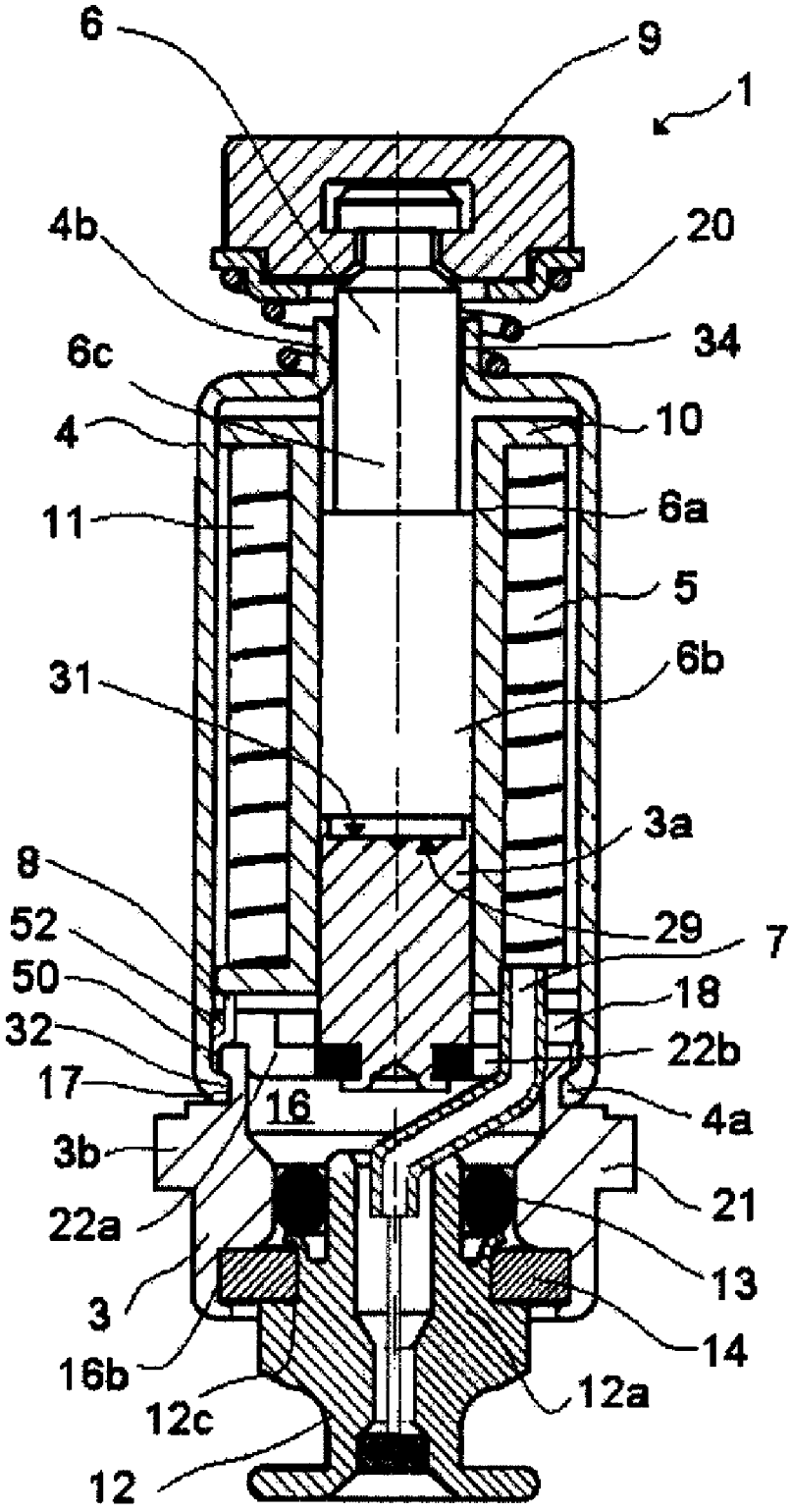
FIG. 6 is a sectioned view of the safety valve of FIG. 5, in a position in which the electromagnetic valve is energised.

In an embodiment of the invention, the support 3, shown in detail in FIGS. 3 and 4, is an integral piece, the base 18 corresponding with an end of the second element 3*b* continuous to the first element 3*a*. In this embodiment, the openings 22*a* and 22*b* are closed holes for which have been passed through the mass wire 8 and the phase wire 7. In one embodiment, the mass wire 8 is fixed to the rear 19 of the housing 16 by a rivet 30 that is inserted under pressure in a blind hole 33 coaxially arranged on the rear surface 19, and traps the mass wire 8 against the rear surface 19, thus preventing the unwanted disassembly that generally occurs with other types of fixings such as welding, due to the contraction of materials.

In one embodiment, the support 3 incorporates a stop element 15, such as an open washer, that is positioned tightly between the rear surface 19 of the housing 16, the rivet 30 and the O-ring seal 13, and which prevents accidental axial and angular movement of the O-ring seal 13 being detrimental to the correct air tightness, as well as ensuring the proper contact of the mass wire 8 against the rear surface 19 of the support 3. Preferably, the stop element 15 is an open washer to allow the passage of the encased phase wire 7.

Figure 7:
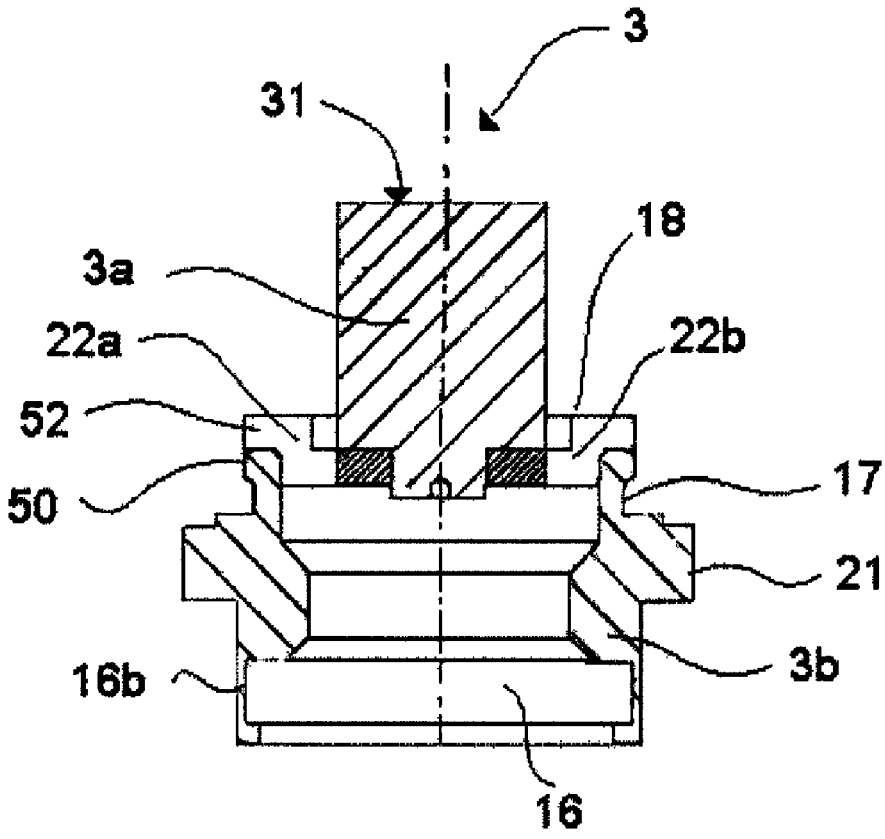
FIG. 7 is a cross-section of a support in an embodiment of the electromagnetic safety valve shown in FIG. 5.
Figure 8:
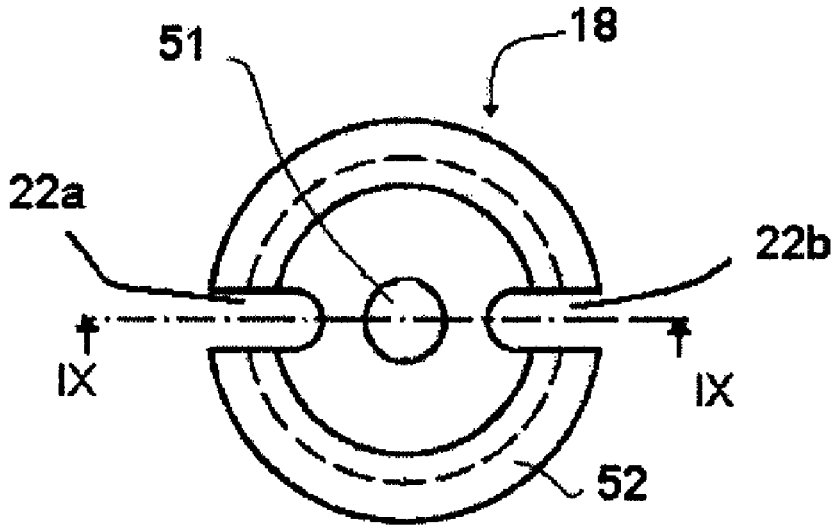
FIG. 8 is a bottom view of a base of the support of the electromagnetic valve shown in detail in FIG. 7.
Figure 9:
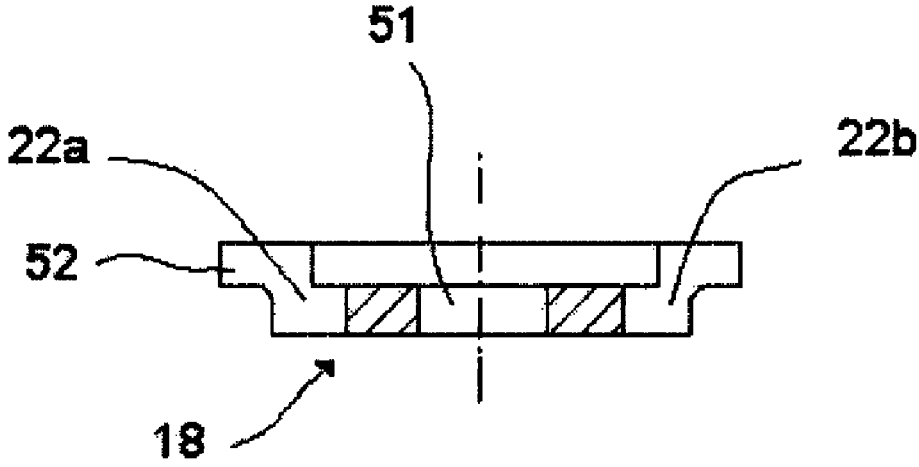
FIG. 9 is a cross-section of the base of the support of the FIG. 8, according to section IX-IX.

In alternative embodiments, as shown in FIGS. 5 to 9, the support 3, shown in detail in FIGS. 7 to 9, is a unit comprising the first element 3*a*, the second element 3*b* and the base 18, these pieces being independent between them, so that the first element 3*a* is fixed tightly to the base 18, being the base 18 inserted in the second element 3*b*. The base 18 is preferably substantially cylindrical and includes a central hole 51 wherein the first element 3*a* is inserted tightly, and an exterior perimeter rim 52 in which the reel 5 is seated, so that the base 18 is inserted tightly in the interior of the second element 3*b*, the external perimeter rim 52 being seated in the end of the second element 3*b*.

In these alternative embodiments, the respective openings 22*a* and 22*b* may be open slots which are preferably diametrically opposed in the base 18, the mass wire 8 passing through one of the two openings 22*a* and 22*b* and being trapped between a lateral surface 50 of the exterior of the base 18 and the casing 4.

Bearing in mind the high reluctance of the magnetic circuit of the electromagnetic valves 1 caused by the air gap between the movable core 6 and the support 3, in alternative embodiments the electromagnetic valve 1 has optimised magnetic closures for the purpose of minimising the magnetic losses in the closures. Thus, in one or more alternative embodiments, a first magnetic closure 32 between the support 3 and the casing 4 includes an exterior perimeter groove 17 in the first segment 3*a* of the support 3, which cooperates with an internal perimeter rim 4*a* included on one end of the casing 4, the internal perimeter rim 4*a* being fixed tightly to the perimeter groove 17 and riveted to the perimeter groove 17 thereby preventing accidental disassembly. Additionally, a second magnetic closure 34 of the magnetic circuit includes on an opposite end of the casing 4, a neck 4*b* that is coaxial and of a smaller diameter than the rest of the casing 4 along which the movable core 6 moves, with a minimum clearance between the neck 4*b* and the movable core 6, so that the neck 4*b* optimises the passage of magnetic flow between the movable core 6 and the casing 4.

In addition, in one embodiment, the movable core 6 has a central part 6*a* fitted to the interior of the bobbin 10 and which is guided when moved along the bobbin 10, a first end 6*b* whose second contact surface 29 closes the magnetic circuit when it comes into contact against the first contact surface 31 of the support 3, and a second end 6*c* of a smaller diameter than the diameter of the central part 6*a*, so that the movable core 6 may not be disassembled once the electromagnetic valve 1 has been assembled, as the internal diameter of the neck 4*b* of the casing 4 is smaller than the diameter of the central part 6*a* of the movable core 6. In one embodiment, the first end 6*b* is of a smaller diameter and a longer length than the central part 6*a* in order to prevent the barbs that may be generated on the surface of the first end 6*b* when it beats against the first segment 3*a* of the support 3, when the electromagnetic valve 1 is energised, from damaging the bobbin 10.

Figure 10:
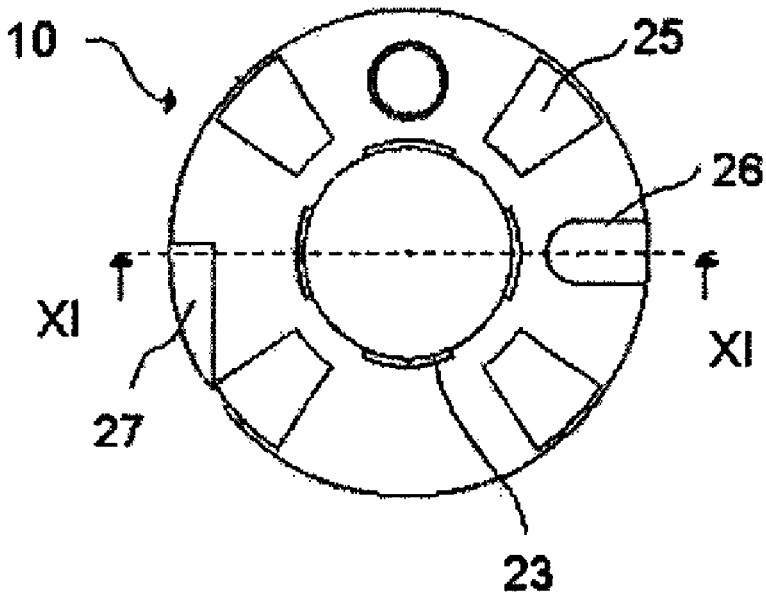
FIG. 10 is a bottom view of a bobbin in one embodiment.
Figure 11:
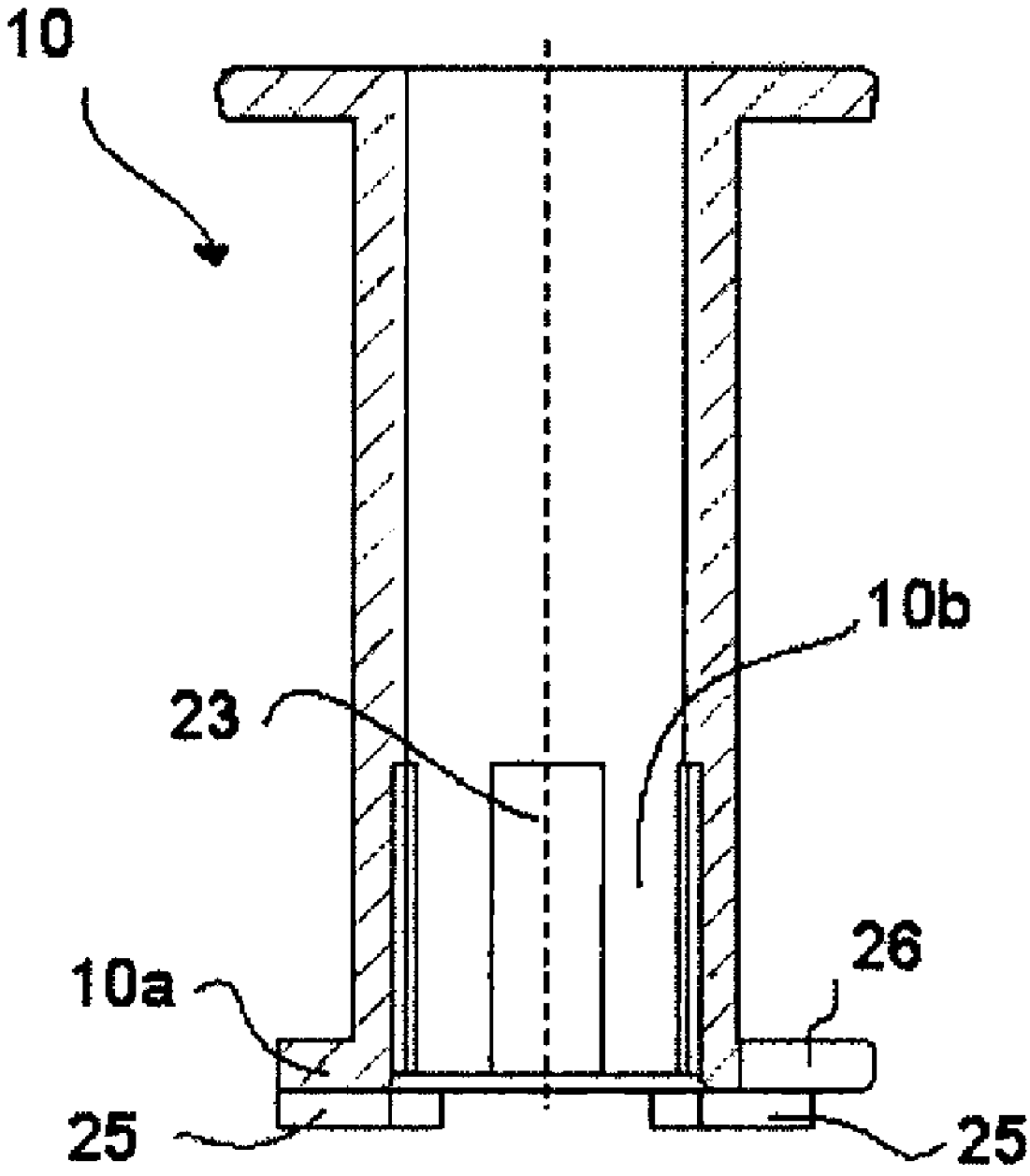
FIG. 11 is a cross-section of the bobbin shown in FIG. 10 according to section XI-XI.

In order to achieve proper guidance of the movable core 6 in the interior of the bobbin 10 during the energizing or de-energizing of the electromagnetic valve 1 it is necessary that the bobbin 10 is itself correctly positioned in relation to the electromagnetic valve 1, this being achieved through the first segment 3*a* of the support 3 that is inserted tightly in a first end of internal surface 10*b* of the bobbin 10. As shown in detail in FIGS. 10 and 11, in one embodiment the first end of internal surface 10*b* incorporates axial grooves 23 of a length slightly superior to the height of the first segment 3*a* of the support 3, these acting as channels for the outlet of the air which accumulates in the interior of the electromagnetic valve 1 and which preferably must be eliminated, for if it is not, it causes an unwanted cushioning effect during the displacement of the movable core 6 in the interior of the bobbin 10 when the electromagnetic valve 1 is energised. The disposition of these axial grooves 23 in the first end of internal surface 10*b* prevents having to form grooves either on the total length of the bobbin 10 or on the movable core 6 itself thus facilitating the mechanisation and bringing about improved guidance of the movable core 6 on the bobbin 10. In one embodiment, the bobbin 10 has on the first end of internal surface 10*b* a base 10*a* from which ribs 25 are disposed radially and alternately in relation to the axial grooves 23 and project out axially towards the exterior of the bobbin 10, the objective being to permit the outlet of air and the passage of the phase wire 7 and the mass wire 8 through the respective openings 22*a* and 22*b*. The base 10*a* of the bobbin 10 also includes an open radial slot 26 through which the encased phase wire 7 is extracted, and a recess 27 formed on the exterior diameter of the base 10*a* of the bobbin 10, the recess 27 being preferably disposed diametrically opposite to the open slot 26, through which the mass wire 8 is extracted, preventing the phase wire 7 and the mass wire 8 from being damaged or broken during the assembly of the electromagnetic valve 1.

Although an electromagnetic safety valve and support have been disclosed in the context of certain preferred embodiments and examples, it will be understood by those skilled in the art that the present invention extends beyond the specifically disclosed embodiments to other alternative embodiments and/or uses and obvious modifications and equivalents thereof. Thus, it is intended that the scope of the present invention herein disclosed should not be limited by the particular disclosed embodiments described above.

What is claimed is:

1. An electromagnetic safety valve for a domestic gas appliance comprising:

a reel comprising a bobbin having an interior passage and an electrical wire reeled onto an exterior surface of the bobbin, a moveable core moveable within the interior passage of the bobbin and having a first contact surface, a sealing member at a first end of the valve which is configured to open or close a passage of gas, the sealing member coupled to the moveable core and being urged in a closed position by a spring, a mass wire electrically coupled to the reel, a phase wire electrically coupled to the reel, a male terminal positioned at a second end of the valve opposite the first end and having a passage for receiving the phase wire, a metallic support comprising a first segment and a second segment, the mass wire being electrically coupled to the support, the first segment acts as a fixed core and comprises an external surface and a second contact surface, at least a portion of the external surface is positioned within the internal passage of the bobbin, the second contact surface configured to make contact with the first contact surface of the moveable core when the valve is energized to hold the sealing member in an open position, the second segment being coaxial or substantially coaxial with the first segment, the second segment having at or near one end a base that supports the reel and at a second end an opening for receiving the male terminal, the base having a first opening for passage of the mass wire and a second opening for passage of the phase wire, and a metal casing enclosing the reel and attached to the support.

2. An electromagnetic safety valve according to claim 1 wherein the support is integrally formed, the second segment being continuous to the first segment.

3. An electromagnetic safety valve according to the claim 1, wherein the external surface of the first segment is fixed within an opening in the base of the second segment.

4. An electromagnetic safety valve according to claim 3 wherein the second segment comprises a first portion and a second portion, the first portion comprising the base, the second portion comprising an annular member having a first end and a second end and a through opening extending there between, the base fixed within the first end and the male terminal fixed within the second end.

5. An electromagnetic safety valve according to claim 1 wherein the mass wire is fixed to the support by means of a rivet which is inserted under pressure in a blind hole arranged in a rear surface of the first segment, the rivet trapping the mass wire against the rear surface of the first segment.

6. An electromagnetic safety valve according to claim 1 further comprising a closure member within the second segment to provide an airtight seal between the male terminal and support, a stop element being positioned within the opening of the second segment adjacent the rear surface of the first segment to prevent axial and angular movement of the closure member.

7. An electromagnetic safety valve according to claim 6 wherein the stop element is an open washer.

8. An electromagnetic safety valve according to claim 1 wherein the first and second openings of the base are each open slots, the mass wire extending through one of the slots and fixed to a lateral surface of the second segment.

9. An electromagnetic safety valve according to claim 1 wherein the second segment of the support has a first perimeter recess and the male terminal has a second perimeter recess, the valve further comprising an insulating member positioned within and between the first and second perimeter recesses, the insulating member providing a double mechanical fixing of the male terminal in the interior of the second segment of the support.

10. An electromagnetic safety valve according to claim 1 wherein a the casing includes at one end an internal perimeter rim and the second segment of the support includes an exterior perimeter groove, the exterior perimeter groove of the second segment fixed tightly within the internal perimeter rim of the casing to produce a first magnetic closure between the support and the casing, a second magnetic closure produced at an opposite end of the casing between a neck of the casing and the movable core for directing the magnetic flow.

11. An electromagnetic safety valve according to claim 1, wherein the second contact surface of the first segment closes the magnetic circuit of the electromagnetic valve against the first contact surface of the movable core, the first contact surface and the second contact surface being substantially flat surfaces.

12. An electromagnetic safety valve according to claim 1 wherein the movable core has an end part coupled to the sealing member and a central part continuous and coaxial to the end part, the end part having a smaller diameter and length than the central part.

13. An electromagnetic safety valve according to claim 12 wherein the casing has on one end a neck through which passes the end part of the movable core, the central part of the movable core having a greater diameter than the internal diameter of the neck to prevent disassembly once the electromagnetic valve has been assembled.

14. An electromagnetic safety valve according to claim 1 wherein the bobbin includes an internal surface and on an end adjacent the support axial grooves formed within its internal surface for the outlet of air that accumulates in the interior of the electromagnetic valve.

15. An electromagnetic safety valve according to claim 14 wherein the internal surface of the bobbin is circular and wherein the axial grooves are equidistantly arranged along the internal circular surface of the bobbin.

16. An electromagnetic safety valve according to claim 14 wherein the axial grooves have a length slightly superior to the height of the first segment of the support to enable the outlet of air.

17. An electromagnetic safety valve according to claim 14 wherein the bobbin includes ribs that extend axially from a base of the bobbin towards the exterior of the bobbin, wherein the ribs are radially and alternately arranged in relation to the axial grooves.

18. An electromagnetic safety valve according to claim 17 wherein the base of the bobbin includes an open slot through which the phase wire is passed and a recess spaced from the open slot through which the mass wire is passed.

* * * * *